US006128789A

United States Patent [19]

Olav

[11] Patent Number: 6,128,789

[45] Date of Patent: Oct. 10, 2000

[54] METHOD AND DEVICE FOR OPERATING THE WATER FLUSHING AND THE DISCHARGE VALVE IN A TOILET OR THE LIKE CONNECTED TO A VACUUM SEWER

[76] Inventor: Hofseth Olav, Lånagjerdet 6, Ulsteinvik, Norway, N-6065

[21] Appl. No.: 09/147,673

[22] PCT Filed: Jun. 10, 1998

[86] PCT No.: PCT/NO98/00176

§ 371 Date: Feb. 11, 1999

§ 102(e) Date: Feb. 11, 1999

[87] PCT Pub. No.: WO98/56997

PCT Pub. Date: Dec. 17, 1998

[30] Foreign Application Priority Data

Jun. 11, 1997 [NO] Norway ..... 972695

[51] Int. Cl.[7] ..... E03D 11/00

[52] U.S. Cl. ..... 4/431; 4/434

[58] Field of Search ..... 4/431, 434, 435, 4/438, 439, 440, 441, 442

[56] References Cited

U.S. PATENT DOCUMENTS 4,713,847 12/1987 Oldfelt et al. .
4,928,326 5/1990 Olin et al. .
5,007,117 4/1991 Oldfelt et al. .
5,165,457 11/1992 Olin et al. .
5,317,763 6/1994 Frank et al. .
5,515,554 5/1996 Clear et al. .

*Primary Examiner*—Robert M. Fetsuga
*Attorney, Agent, or Firm*—Nixon Peabody LLP; David S. Safran

[57] ABSTRACT

A method for controlling the discharge valve (3) and preferably the flushing of a toilet or the like in a vacuum sewer system is characterized in that the discharge valve opens and closes with velocities providing an opening time which is less than 0.75 and a closing time which is less than 0.75 second. Further, a device for controlling the discharge valve (3) and flushing of a toilet or the like in a vacuum sewer system where the device and discharge valve are driven by means of the vacuum being generated in the drainage system (27) is characterized in that the device (5) includes at least three operation valves, a first (10), second (9) and third (11) valve. The valves are provided to be set or reset by means of a common piston rod in the form of a cam (12) which is driven by a piston (7) in a cylinder housing (6). The first valve (10), which is triggered by a start device (23), is provided to connect the chamber of the cylinder (6) with the vacuum source in the sewer pipe (27) system via the respective conduits, pipes and vacuum reservoir (21, 25, 26). The second valve (9) is set by the cam (12) and is provided to connect the vacuum source in the sewer pipe (27) with the driving device (29, 64) for the discharge valve (3). Finally the third valve (11) is set by the cam (12) and is provided to connect a flushing ring (2) or the like with a water source via pipes and conduits (33, 34).

9 Claims, 7 Drawing Sheets

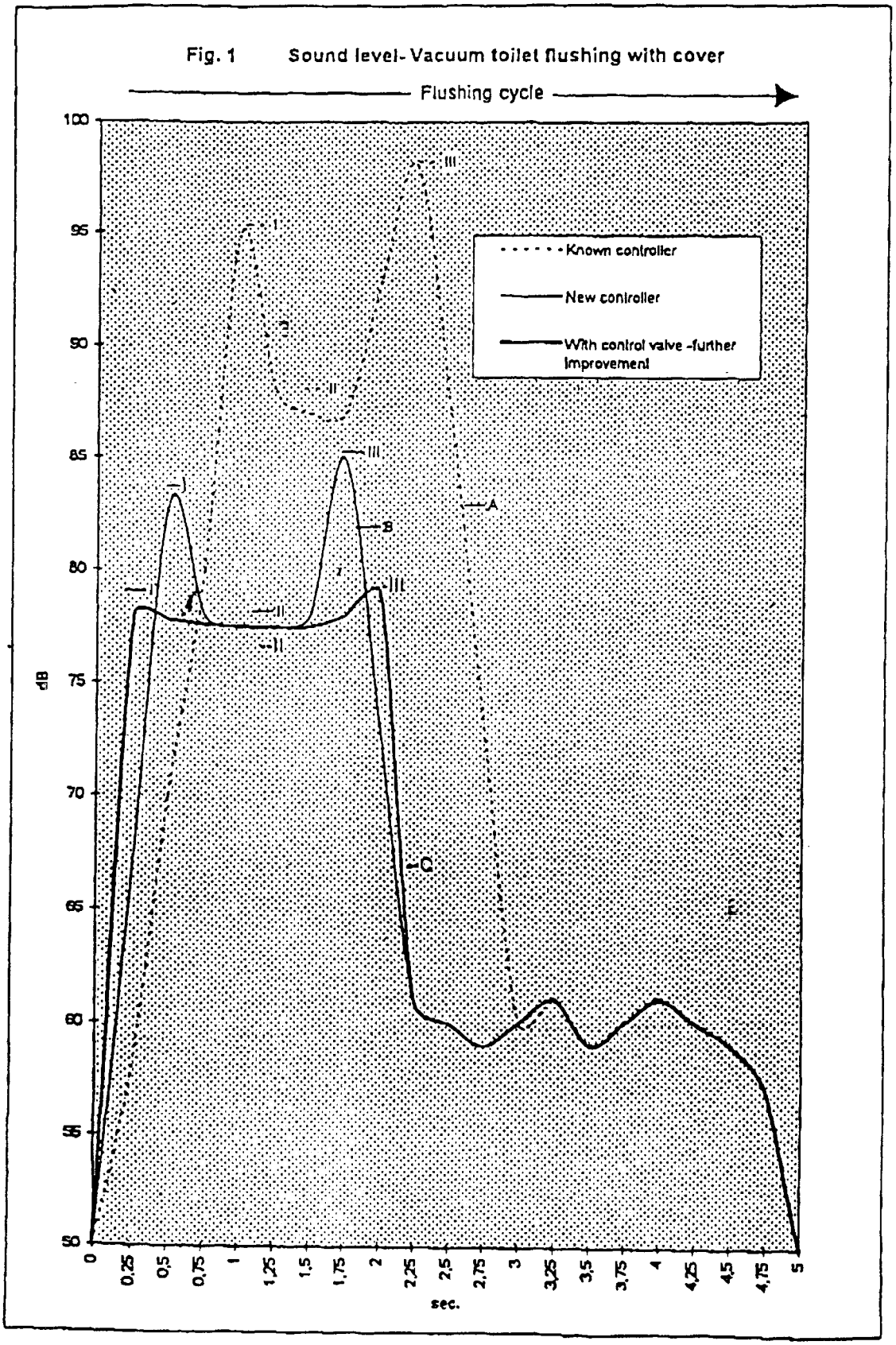
Fig. 1 Sound level- Vacuum toilet flushing with cover
Flushing cycle
Known controller
New controller
With control valve -further improvement
dB
sec.
100
95
90
85
80
75
70
65
60
55
50
0
0,25
0,5
0,75
1
1,25
1,5
1,75
2
2,25
2,5
2,75
3
3,25
3,5
3,75
4
4,25
4,5
4,75
5
A
B
C
D
E
I
II
III

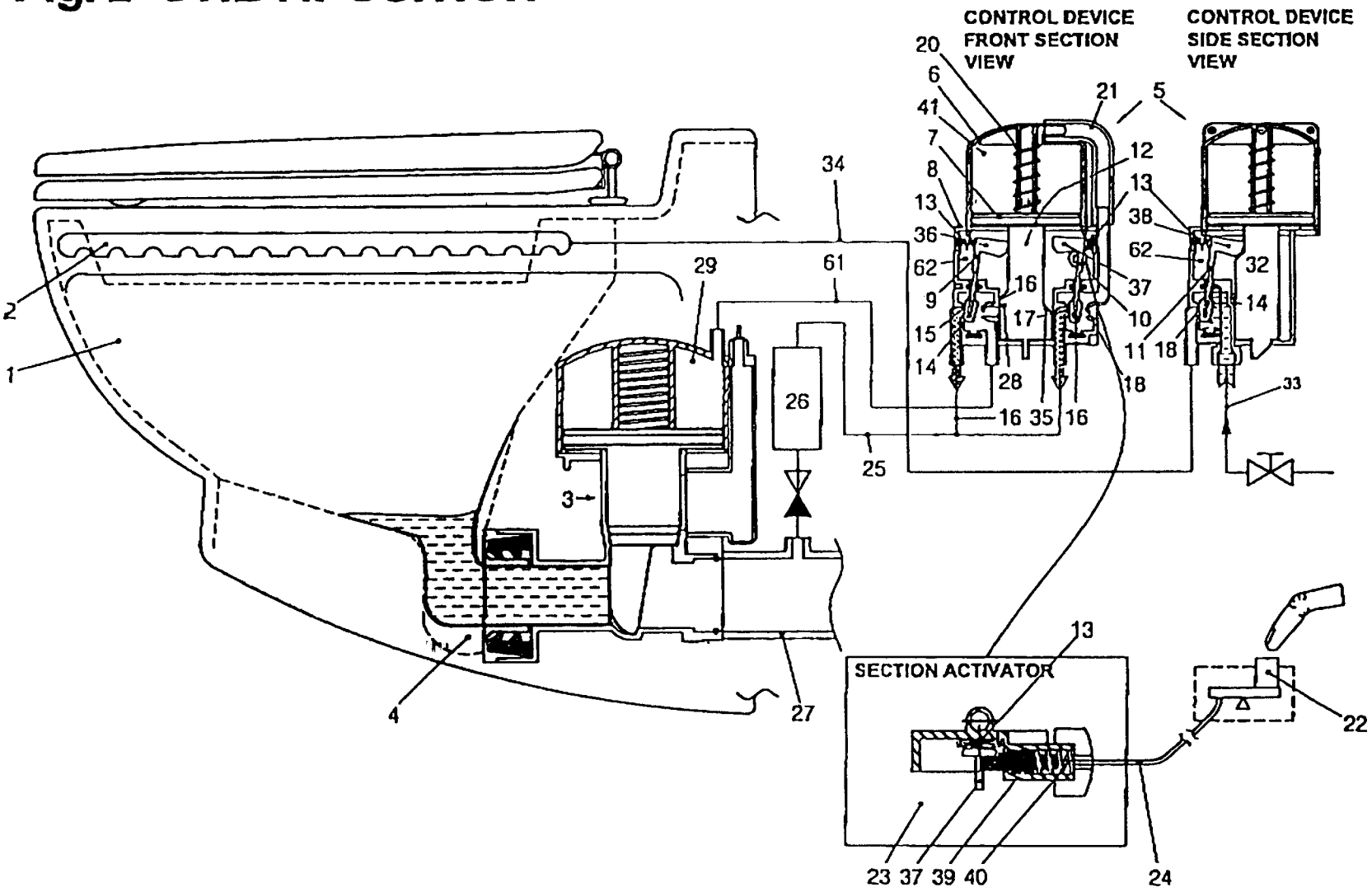
Fig. 2 ST.BY.POSITION

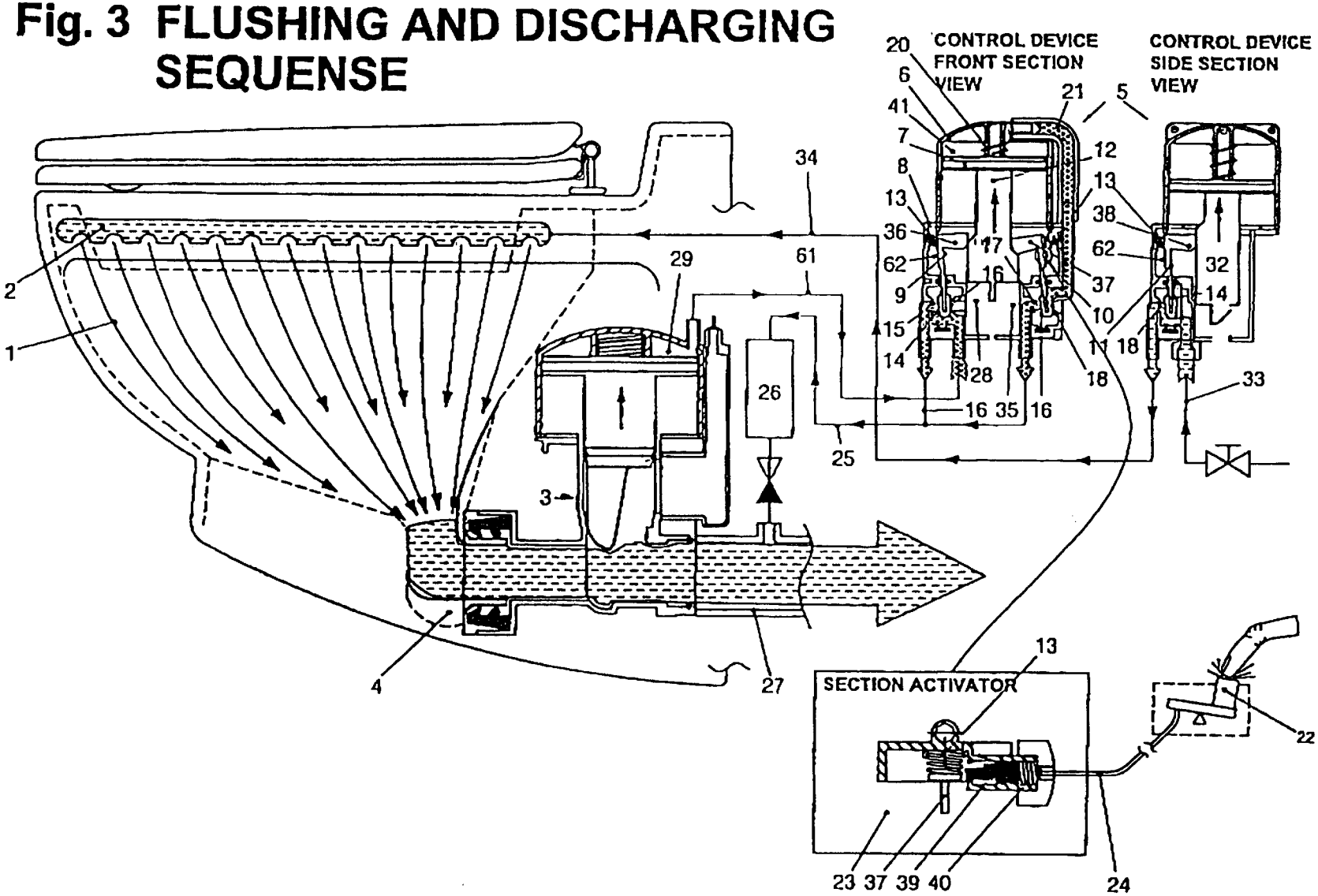
Fig. 3 FLUSHING AND DISCHARGING SEQUENSE

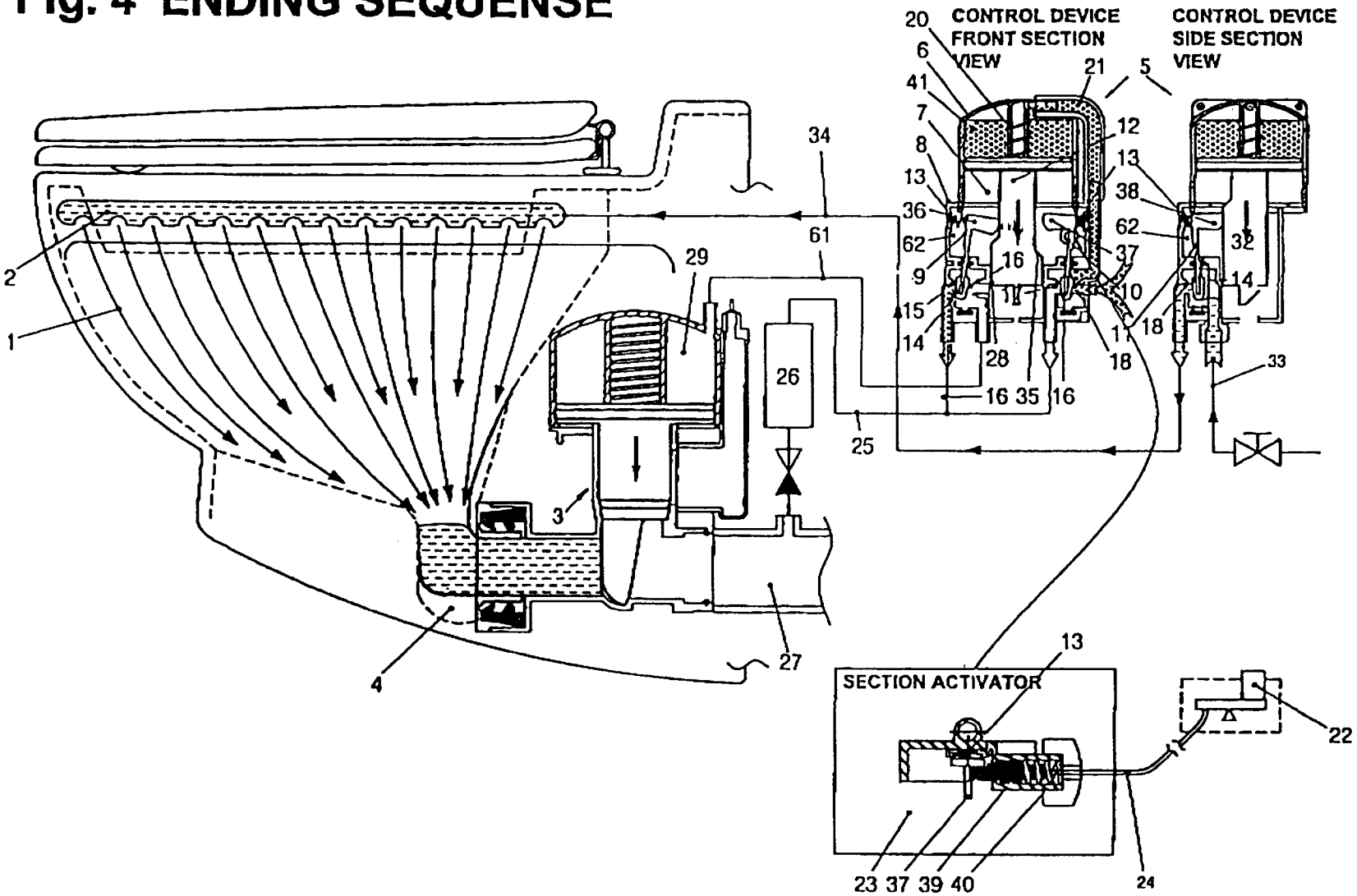
Fig. 4 ENDING SEQUENSE

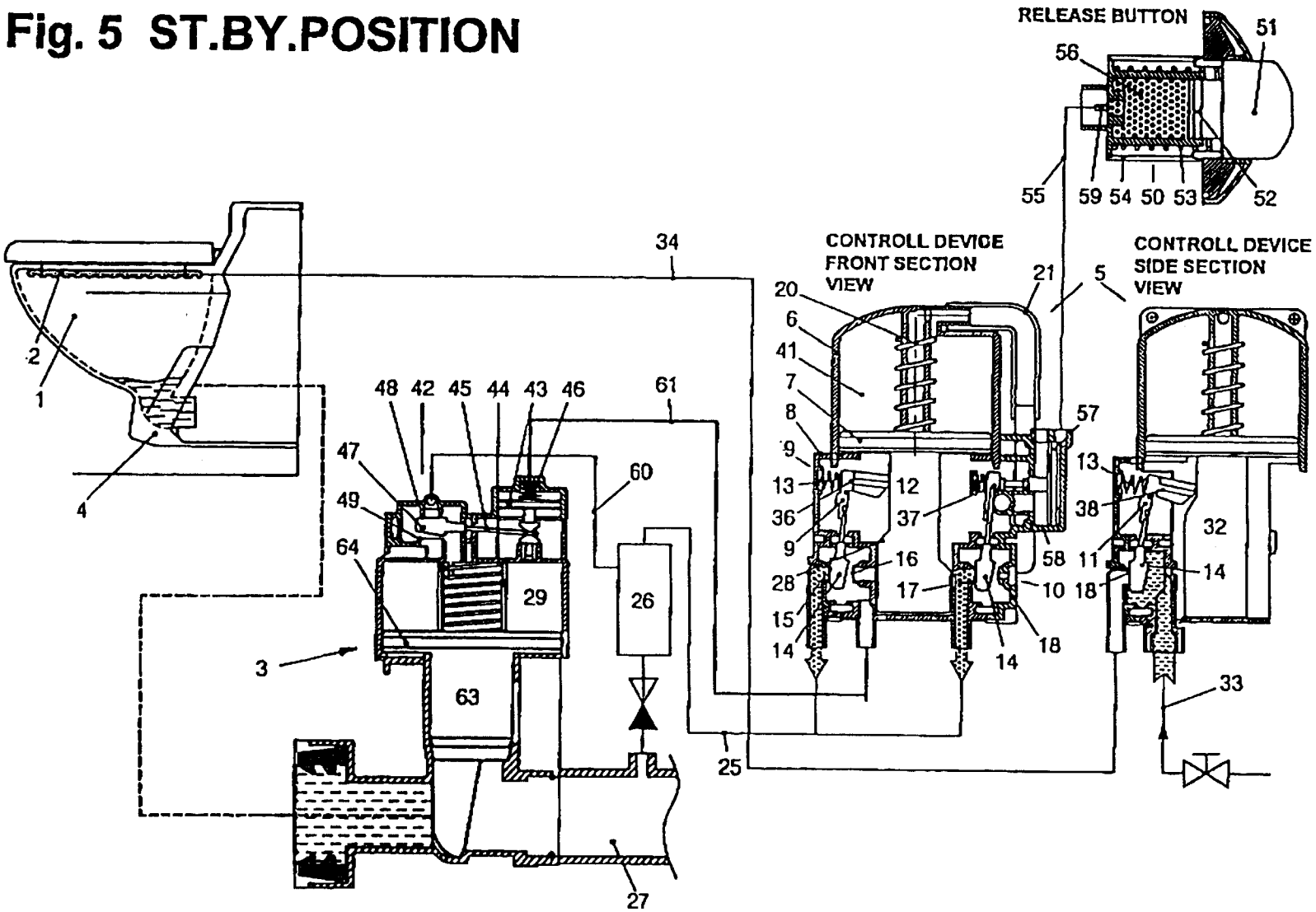
Fig. 5 ST.BY.POSITION

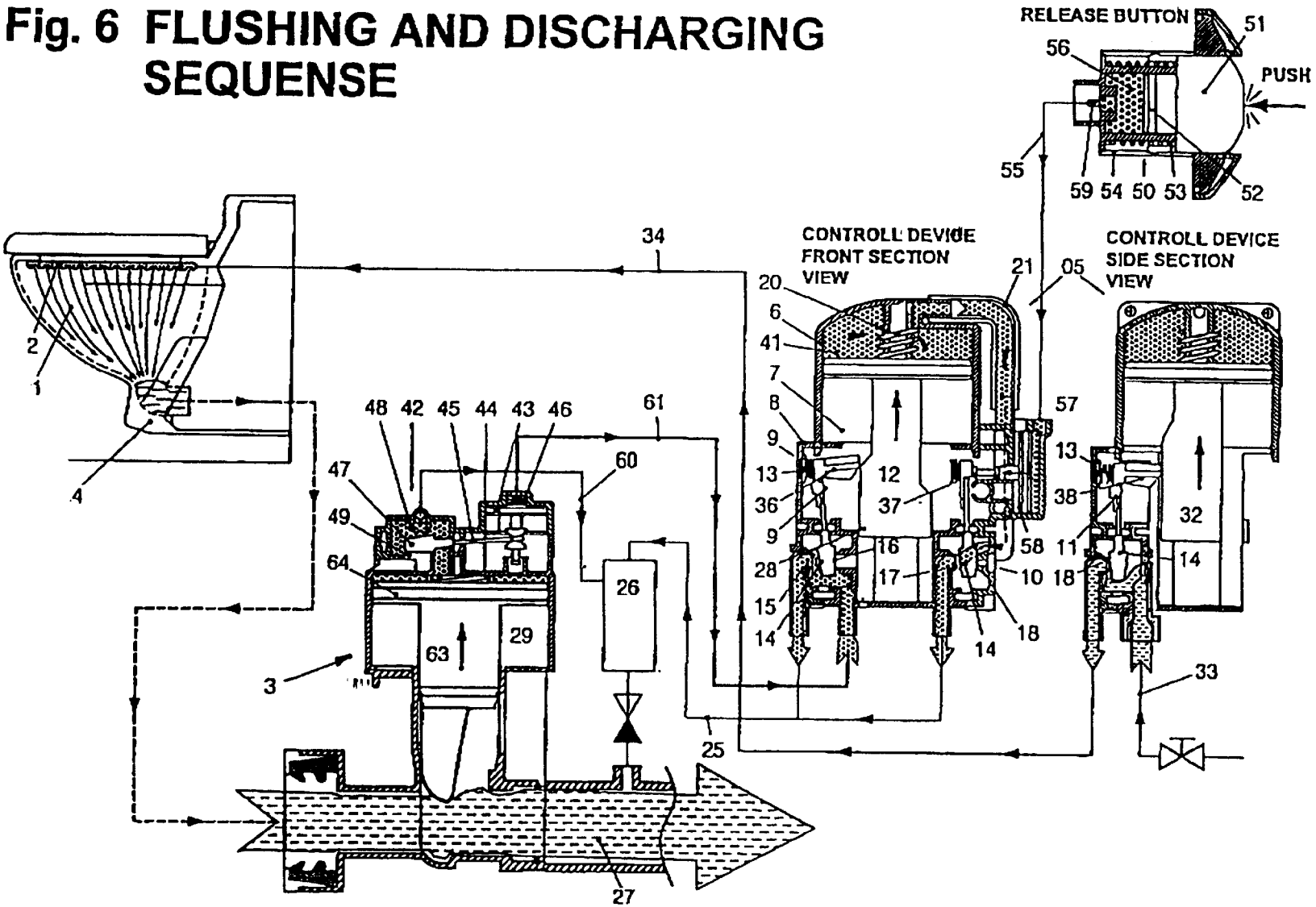
Fig. 6 FLUSHING AND DISCHARGING SEQUENSE

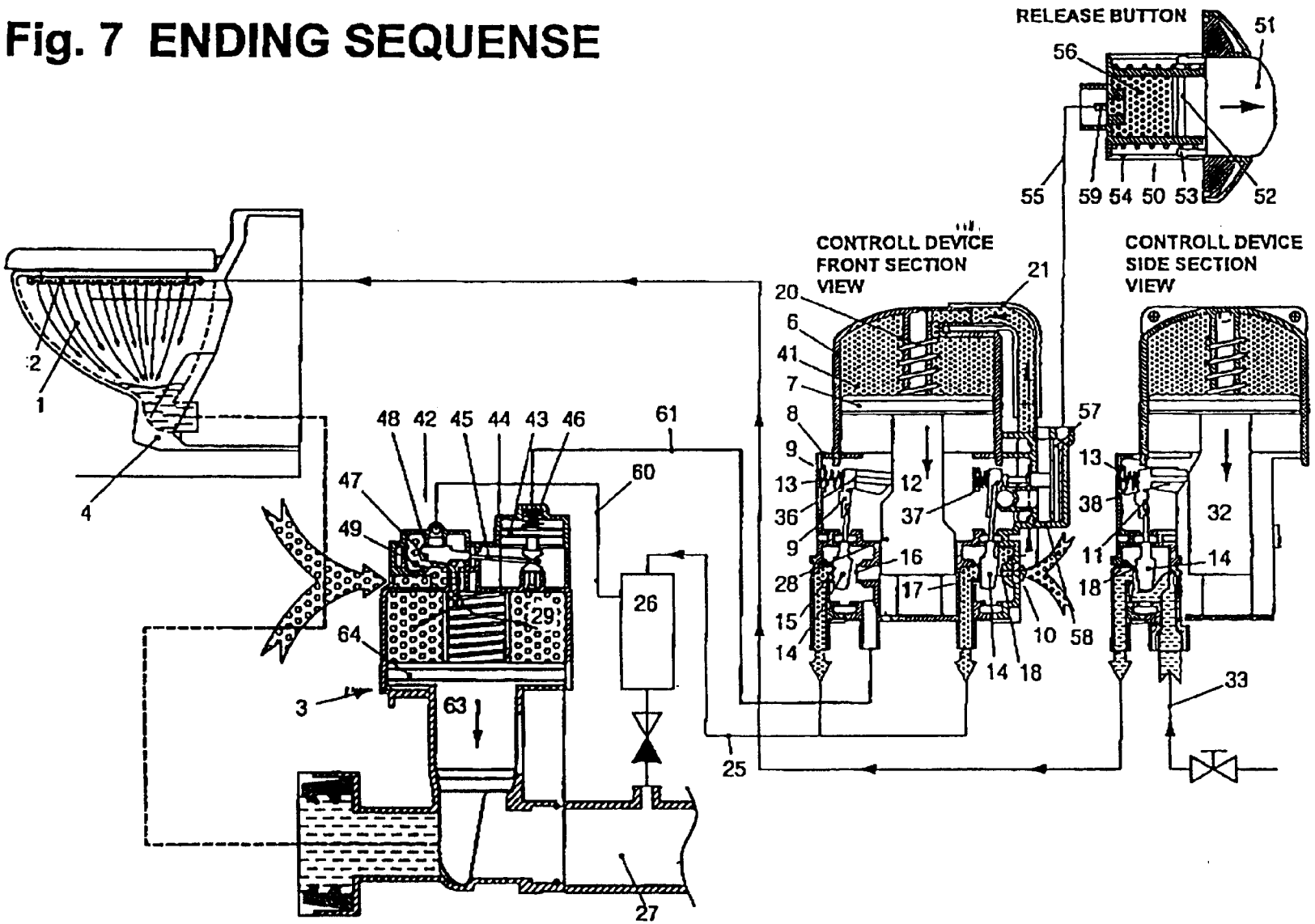
Fig. 7 ENDING SEQUENSE

METHOD AND DEVICE FOR OPERATING THE WATER FLUSHING AND THE DISCHARGE VALVE IN A TOILET OR THE LIKE CONNECTED TO A VACUUM SEWER

The present invention relates to a method and device for operating the water flushing and the discharge valve in a toilet or the like in a vacuum sewer system.

In a vacuum sewer system the vacuum is provided by means of one or more vacuum pumps which are either directly connected with the collecting pipe (drainage pipe) from the toilets, urinals or the like in the system, or connected with a vacuum tank to which the collection pipe is connected.

A disadvantage with the commonly known vacuum sewer systems is that strong noise is created when the toilets are discharged, i.e. when the discharge valve for the respective toilet or the like opens. Particularly, there is a peak noise immediately after the opening of the discharge valve starts, and an additional peak noise when the closing of the valve starts. These peak noise levels are due to the throttling of the outlet opening through the discharge valve.

Several methods and means have been tried to reduce the noise from toilets or the like in vacuum sewer systems. Inter alia it is commonly known to use air tight or noise absorbing toilet lids, as well as to apply false air in connection with the discharge valve. But such methods and means have reduced the noise quite marginally, i.e. 1–3 decibels.

Surprisingly, when testing the discharge function in vacuum toilets, the inventor found that the noise could be reduced significantly by reducing the opening and closing time for the discharge valve. According to the invention the inventor arrived at a method for controlling or operating the discharge valves in sewer systems which is characterised in that the discharge valves opens at a speed which gives an opening time which is lower than 0.75 second, and closes at a speed that gives an opening time of less than 0.75 second.

Further, the inventor arrived at an operating or control device that fulfills the above criteria as regards operating speed, and which is characterised in that it comprises three operating valves that are controlled by a cam device which is driven by a piston/cylinder device, whereby the first operating valve, being triggered by a start mechanism, is provided to connect the chamber in the cylinder device with the vacuum source in the collecting pipe via a corresponding supply channel, conduits and vacuum reservoir, the second valve is provided to connect the vacuum reservoir with the drive unit for the discharge valve via corresponding conduits, and the third operating valve is provided to connect the flushing ring for the toilet with a water supply via corresponding conduits.

The independent claims 2 and 4–8 define advantageous features of the invention.

The invention will now be further described by means of examples and with reference to the drawings in which, FIG. 1 shows a diagram for the noise level versus the time for the opening and closing of a discharge valve in a toilet, where the method according to the invention and an improvement of the method is compared with a known solution, and FIGS. 2–4 show three sequences of a toilet with a discharge valve, flushing device and operating device according to the invention, FIGS. 5–7 show three sequences of the same devices as in FIGS. 2–4, but with an alternative release button and an additional operating valve for the discharge valve.

As mentioned above, peak noise levels occur when the discharge valve in a toilet of a vacuum sewer system is respectively opened and closed. These peak noise levels are created in the through flow opening of the valve when the valve body or valve closing member is on its way up or down and thereby makes a throttling of the through-flow opening of the valve. It is the fluid (air) passing through the narrow opening that makes the noice when it reaches a certain velocity. The water in the toilet bowl as well as the air being present in the system represents a mass which is subjeted to accelleration when the valve opens. In principle the valve therefore has to open at such speed that it will be fully open (no restriction in the throug flow of it) before the air reaches the velcity that creates the noice. FIG. 1 shows the noise level in decibels as a function of time for an earlier known operating device, shown with a dotted line, A, and the noise level for the operating method according to the invention, shown as a continuously drawn line B. The darker, continuously drawn line C shows an improvement which will be commented at the end of the description. As will be apparent from FIG. 1, the noise increases when the discharge valve opens, until it reaches a top (at I) when the throttling of the valve is at a maximum. Thereafter the noise level decreases and flattens out (at II) when the valve is completely open, and further increases when the valve closes until it reaches a second peak (at III) when the throttling of the valve again is at a maximum. By studying the two curves A and B of the diagram in FIG. 1 one will see that the opening as well as the closing time for the discharge valve with the operating method according to the invention is essentially shorter than for the known solution. More clearly, the opening and closing time for the invention is respectively 0.25 and 0.4 seconds, while the opening and closing time for the known solution is 0.8 and 1.3 seconds respectively. The noise level as well is dramatically lower, close to 15 decibels.

Thus, with the present invention it has been found that the noise in a vacuum sewer system, where discharge valves are used in toilets or the like, can be reduced to a large extent by reducing the opening and closing time for the discharge valve. Tests have shown that the discharge valves in known vacuum sewer systems are operated with opening times between 0.8 and 1.0 second, while the closing times are between 1.1 and 1.6 second. All reductions of the opening and closing times of a discharge valve in such systems below 0.8 and 1.1 second respectively, gives reduced noise for the discharge valve.

The question of whether it will be possible to achieve opening and closing times below these values, will be dependent on whether the discharge valve as well as the operating device for such valve is sufficiently fast. The inventor has previously developed such fast discharge valve which is described in Norwegian patent application No. 943535 and which is shown in the enclosed FIGS. 2–7 (will not be further described).

The present invention also relates to a operating or control device for a discharge valve, which, in combination with the previously patented discharge valve enables opening and closing times for the discharge valve below 0.8 seconds. This operating device will be described in the following with reference to FIGS. 2–4.

The figures show a toilet 1 with a flushing ring 2 mounted therein, a discharge valve 3 provided in the outlet pipe 4 of the toilet, and an operating or control device 5 according to the invention seen respectively in front and side section view. As the components in FIGS. 2–4 are the same and only reveals different sequences as regards the functioning of the invention, reference is initially only made to FIG. 2 when describing the constructive design of the control device 5.

The control device is composed of a unit comprising an upper cylinder housing 6 with a movable piston 7 and a lower valve housing 8 with three different operating valves, a first valve 9, a second valve 10 and a third valve 11, in addition to a piston rod shaped like a cam device 12. The valves 9, 10 and 11 are of the same type, namely of the balance arm type where the balance arm 36, 37 and 38 respectively is pre set by a spring 13 and where a valve body 14 on the opposite side of the arm is designed to be resting against valve seats (openings) 15, 16, 17, 18, 19 in respective valve chambers 62 for the valves 9, 10 and 11.

The piston 7 is pre loaded by a spring 20 and is kept in a lower position when the operating device and discharge valve is in a resting, closed position as shown in FIG. 2. In this position the valve opening 17 for the operating valve 10 closed, while the valve opening 18 is open to the atmosphere via the conduit 21.

A release (start) device 23 is provided in connection with the valve arm 37 in the valve 10, see enlarged cross section of release device 23 below the toilet in FIGS. 2–4. This device includes a locking pin 39 which is pre loaded by a spring 40 and which keeps the balancing arm 37 pressed against the spring 13.

By pressing the start button 22 on the release device, a pull wire 24 in turn pulls the locking pin 39 backwards whereby the arm 37 for the valve 10 opens the valve opening 17 and closes the valve opening 18. Thereby air flows from the cylinder chamber 41 above the piston 7 via the conduit 21, through the valve 10 and further through the pipe line 25 and vacuum reservoir 26 and to the discharge pipe 27 being under vacuum. As shown in FIG. 3 the piston 7 now will move towards an upper position. This in turn result in that the protrusion 28 on the cam device 12 moves the valve arm 36 in the valve 9 such that the valve closes the opening 16 to the atmosphere and opens the through-flow of air from the piston chamber 29 of the discharge valve 3 via pipe lines 16, 25 and further to the reservoir 26. Thereby the discharge valve 3 opens for the emptying of the content in the toilet bowl. Just before the setting of the valve 9 by means of the cam protrusion 28, the cam protrusion sets the valve 11 by turning the balance arm with the valve body 14 away from the valve opening 19 such that water flows through the valve 11 from a water reservoir (not shown) via pipe lines 33, 34 and to the flushing ring 2 for flushing of the toilet 1.

When the piston 7 has reached its uppermost position in the cylinder housing 6, the cam protrusion 35 acts on the balance arm in the valve 10 whereby the valve resets and opens for the supply of air from the atmosphere via the conduit 21. At the same time the release device 23 resets so that the operating device will be ready for a new discharging and flushing of the toilet. The piston 7 will now, due to the force from the spring 20, return to its initial position as shown in FIG. 4, and the cam device will, by its return movement, firstly reset the valve 9 such that air from the atmosphere will flow from the valve opening 16 via the pipe line 61 to the cylinder 29 of the discharge valve 3 whereby it will close, and thereafter the cam device will reset the valve 11 such that it will close the supply of water to the toilet. The control device will no be in its initial standby position, ready for a new operation.

The speed of the piston 7 in the operating device housing 6 will, beyond the force of the spring 20, be dependent on how quick the air is evacuated from, respectively supplied to the cylinder chamber 41. This evacuation/supply of air may preferably be controlled by a throttling device (not shown) in connection with the valve 10.

In a preferred embodiment of the invention as shown in FIGS. 5–7 the opening and closing time of the discharge valve is further reduced by the use of an additional, fourth operating valve 42 preferably provided on top of the discharge valve 3 which now is "taken out of" the toilet and shown on the outside of it. The main object with this fourth valve 42 is to provide for rapid supply, respectively evacuation of air from the cylinder chamber 29 of the discharge valve 3 and thereby accomplish faster opening and closing of the discharge valve. The operation valves 9, 10 and 11 are the same as in the previous examples, but in stead of being connected directly with the chamber 29 of the discharge valve 3, the connection line 61 from the valve 9 now is connected with a piston/cylinder arrangement 43/44 in the fourth operation valve 42. The piston 43 which is held in a lower, standby position by means of a spring 46, is provided to move a balance arm 45 and thereby the valve body 47 on the opposite end of the arm from an upper position where it rests against a valve seat 48 (valve opening to vacuum reservoir 26) and a lower position where it rests against a valve seat 49 (opening between the atmosphere and the cylinder chamber 29 of discharge valve).

FIGS. 5–7 also show another embodiment of a release device 50. The release device includes in this example a push button 51 with a piston 52 being preloaded by a spring 53 provided in a cylinder 54. The cylinder chamber 56 of this device is filled with a fluid, preferably air, which is provided to trigger the valve 10 by means of a trigger mechanism 57, 58. An orifice 59 (not further shown) controls the return of the fluid to the cylinder 56 to withhold for a short time the trigger mechanism 57, 58 and thereby obtain sufficient opening time for the operation valve 10. The operation of the embodiment shown in FIGS. 5–7 will now be described in the following. FIG. 5 shows the standby position where the discharge valve 3 is in closed position. By pushing the button 51 the fluid in the cylinder chamber 56 will, via the pipe line 55, be supplied to the trigger mechanism for the valve 10 which is in the form of a piston/cylinder device 57, 58 respectively. The piston 57 will now move the balance arm and thereby the valve body 14 for the valve 10 from left to right, i. e. where it closes the opening 18 and opens the opening 17 as shown in FIG. 6. Now air will flow from the cylinder chamber 41 via line 25 to the vacuum reservoir 26. As the piston 7 with the cam 28 now moves upwards, the balance arm and thereby the valve body 14 of the valve 9 is moved from left to right and opens the opening 15 and closes the opening 16. The cam has also just triggered the water flushing valve 11 (formerly described with reference to FIGS. 2–5 and will therefore not be repeated here).

As the valve body 14 of the valve 9 now opens the valve opening 15, the air in the cylinder 44 of the fourth operation valve 42 will be evacuated through pipe line 61, the operation valve 9 and to the vacuum reservoir 26 via lines 16 and 25. The piston of valve 42 now moves upwards and thereby the balance arm 45 such that the valve body 47 closes the opening 49 and opens the valve opening 48. Air is now evacuated rapidly from the cylinder chamber 29 of the discharge valve directly to the vacuum reservoir 26 via pipe line 60, and the piston 64 and thereby the valve body 63 of the discharge valve 3 is moved fast upwards to its open position and the toilet will now be discharged. The rapid evacuation of air from the chamber 29 of the discharge valve is accomplished by the use of this valve as it provides for the use of larger valve openings, larger diameter of the pipes and shorter distance between the chamber 29 and the reservoir 26 (less flow resistance).

As soon as the piston 52 with the push button 51 of the release device is returned to its initial start position, the valve 10 will reset, closing the valve opening 18 and open the valve opening 17. This in turn will provide for the supply of air from the atmosphere via the valve opening 17 to the chamber 41 of the control valve 5 and the piston 7 with the cam 12 of the control device will move downwards as shown in FIG. 7 (ending sequence). Now as the cam 12 moves downwards, the operating valve 9 will be reset and thereby close the valve opening 15 and open the valve opening 16. This will provide for supply of air from the atmosphere through the valve opening 16 in valve 9, further through the pipe line 26 to the cylinder 44, whereby the valve 42 will reset, closing opening 48 and open the opening 49 to supply air to chamber 29 of the discharge valve 3 from the atmosphere. The piston 64 of the discharge valve 3 will now move downwards closing the discharge valve. The control device and discharge valve is now in a reset position ready for a new operation.

Curve C in FIG. 1 shows the improvement of the noise level with the additional fourth operation valve 42. As can be seen from this figure, the peak noise levels I and III are nearly vanished due to the fact that the opening and closing times of the discharge valve has been further reduced. Thus, with the fourth operation valve the noise has been reduced by additional 6–7 decibels.

With the present invention is provided, in addition to a method, a device for the control of the flushing water and a discharge valve for toilets in vacuum sewer system which is compact, is composed of very few parts whereby it is simple and cheap to build and maintain and has a very fast operation.

What is claimed is:

1. Method for controlling the discharge valve (3) and preferably the flushing of a toilet or the like in a vacuum sewer system, characterized in that the discharge valve opens and closes with velocities providing an opening time which is less than 0.5 and a closing time which is less than 0.75 second.

2. Method for controlling the discharge valve (3) and preferably the flushing of a toilet or the like in a vacuum sewer system, characterized in that the discharge valve opens and closes with velocities providing an opening time which is less than 0.75 and a closing time which is less than 0.75 second, wherein the opening and closing times are respectively 0.25 and 0.4 second.

3. Device for controlling the discharge valve (3) and flushing of a toilet or the like in a vacuum sewer system where the device and discharge valve are driven by means of the vacuum being generated in the drain age system (27), characterized in that the device (5) includes at least three operation valves, a first (10), second (9) and third (11) valve, which are provided to be set or reset by means of a common piston rod in the form of a cam (12) which is driven by a piston (7) in a cylinder housing (6), whereby the first valve (10), which is triggered by a start device (23, is provided to connect the chamber of the cylinder (6) with the vacuum source in the second valve (9) is set by the cam (12) and is provided to connect the vacuum source in the sewer pipe (27) with the driving device (29, 64) for the discharge valve (3), and the third valve (11) is set by the cam (12) and is provided to connect a flushing ring (2) or the like with a water source via pipes and conduits (33, 34).

4. Device according to claim 3, characterized in that the valves (9, 10, 11) are of the balance arm type each with a tumably provided arm (36,37,38) which is preloaded by a spring (13) and which arm at one end is provided with an elastic valve body (14) being designed to rest tightly against valve seats (15, 16; 17, 18; 19) for openings provided on one or both sides of the valve housing, and on the other end is provided to be moved by a triggering device (23, 51, 52, 56) or cam protrusions (28,35,32) on the piston rod (12) for closing or changing the through-flow of the valve.

5. Device according to claim 3, characterized in that the control device is provided with a fourth operation valve (42) being designed to rapidly evacuate, respectively supply air to the driving device (29,64) for the discharge valve 3, which fourth valve is controlled by the second valve (9).

6. Device according to claim 5, characterized in that the fourth valve is of the balance arm type (45, 47), which balance arm (47) is provided to be turned by a piston/cylinder device (43, 44) where the piston is preloaded by a spring (46) to keep one end of the arm in a lower position whereby a valve body (47) on the other end is held tightly against an upper valve seat (48) in a stand by position and can be turned by the piston (43) to rest against a lower seat (49) when being controlled by the second valve (9).

7. Device according to claim 3, characterized in that the release device (23) is a locking pin type, where the locking pin (39) is preloaded by a spring (40) and can be moved by a push button (22) via a wire (24), which locking pin is provided to hold the valve arm (37) of the valve (10) in a preset position against a spring (13) where the valve body (14) closes against the valve seat (17) for the opening to the vacuum reservoir, and which locking pin releases the arm (37) when it is pulled out of its locking position, such that the valve body (14) opens the valve opening (17) and closes the valve opening (18).

8. Device according to claim 7, characterized in that the locking pin (39) is reset when the cam (35) of the piston rod (12) is in its upper position and presses the valve arm (37) back to its initial position.

9. Method according to claim 1, characterized in that the opening and closing times are respectively 0.25 and 0.4 second.

* * * * *